United States Patent [19]

Miyamoto et al.

[11] 4,281,214

[45] Jul. 28, 1981

[54] IGNITION COIL COVER

[75] Inventors: Yoshimi Miyamoto; Tetsuo Tanigawa, both of Toyota, Japan

[73] Assignees: Nippondenso Co., Ltd., Kariya; Toyota Jidosha Kogyo Kabushiki Kaisha, Toyota, both of Japan

[21] Appl. No.: 76,956

[22] Filed: Sep. 19, 1979

[30] Foreign Application Priority Data

Jan. 26, 1979 [JP] Japan ..... 54/9449[U]

[51] Int. Cl.[3] ..... H01R 13/52; H01R 39/60

[52] U.S. Cl. ..... 174/138 F; 200/19 WG; 336/90

[58] Field of Search ..... 336/90, 92, 105, 107; 174/138 F, 48, 66, 67; 339/36, 44 R, 39, 75 P, 116 R, 116 C; 200/19 WG; 123/148 D, 634

[56] References Cited

U.S. PATENT DOCUMENTS

| | | | |
|---|---|---|---|
| 1,748,650 | 2/1930 | Hollenbeck | 174/138 F |
| 2,834,829 | 5/1958 | Brouerman | 174/138 F |
| 2,927,955 | 3/1960 | Crawford | 174/138 F |
| 3,144,506 | 8/1964 | Gunthel, Jr. | 174/138 F X |
| 3,403,666 | 10/1968 | Soehner et al. | 123/148 D |
| 3,428,936 | 2/1969 | Arnao, Jr. | 339/44 R X |
| 3,639,681 | 2/1972 | Ettlinger | 174/138 F |
| 4,169,643 | 10/1979 | Gallagher | 339/44 R X |

FOREIGN PATENT DOCUMENTS

| | | | |
|---|---|---|---|
| 1064872 | 10/1952 | France | 174/138 F |

*Primary Examiner*—Thomas J. Kozma

*Attorney, Agent, or Firm*—Cushman, Darby & Cushman

[57] ABSTRACT

An improved ignition coil cover is generally shaped like a cup and divided into two parts or first and second cover segments. The segments are assembled and fitted on an ignition coil so that salt water, water or the like is prevented from entering the cover.

2 Claims, 5 Drawing Figures

IGNITION COIL COVER

The present invention relates to an improved construction for ignition coil covers.

In the past, known covers of the above type have been generally so constructed that each cover is made in a single undivided piece which is generally shaped like a cup and a cutout is formed in the outer diametral portion of the cover so as to extend through from the upper end to the lower end for passing a high tension cord therethrough. However, this type of known cover is disadvantageous in that since the cutout extends from the upper end to the lower end of the outer diametral portion, salt water, water or the like tends to enter the cover, thus causing leakage of the voltage through the high tension cord connection and the primary terminal portions. While the use of a one-piece cover having no cutout formed therein has been considered in an attempt to overcome the difficulty, this attempt has not proved effective due to the necessity to preliminarily pass a high tension cord through the cover and the resulting complicated operation for connecting the high tension cord to the ignition coil.

It is therefore the object of the invention to provide an improved ignition coil cover which is divided into two equal parts, thus eliminating the provision of a cutout into which a high tension cord is to be inserted and simplifying the mounting of the cover on the ignition coil and thereby overcoming the deficiencies in the prior art.

These and other objects, features and advantages of this invention will be apparent from the following description taken in conjunction with the accompanying drawings, in which.

Figure 1:
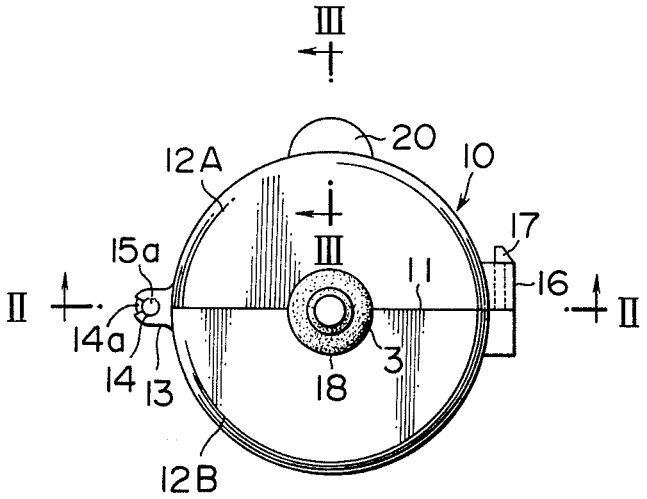
FIG. 1 is a plan view showing an embodiment of the invention.
Figure 2:
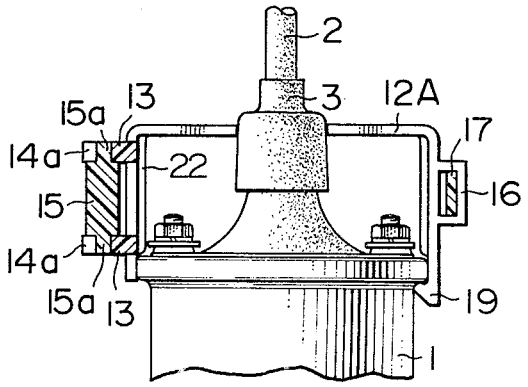
FIGS. 2 and 3 are sectional views taken respectively along the line II—II and III—III of FIG. 1.
Figure 3:
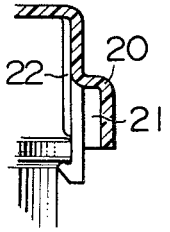

The embodiment of the invention shown in FIGS. 1 to 3 will now be described. In the Figures, numeral 1 designates an ignition coil, 2 a high tension cord connected to an ignition coil terminal, and 3 a rubber cap fitted on the joint of the high tension cord 2 and the ignition coil terminal. Numeral 10 generally designates a cover according to the invention. The cover 10 is made of a resin material, fitted over the ignition coil 1 to enclose the terminal portions thereof, formed into a generally cuplike shape and divided at a longitudinal parting line or joining face 11 into a first cover segment 12A and a second cover segment 12B which are assembled to make the whole cover 10.

A pair of projections 13 are provided on the outer surface of the first cover segment 12A at positions corresponding to the parting line 11 and the projections 13 are vertically spaced a predetermined distance from each other. Each of the projections 13 is formed with a hole 14 and a tapered notched slot **14*a* extending from the outer periphery to the hole 14. On the other hand, the second cover segment 12B is formed with a support shaft 15 adapted to be positioned between the projections 13 and the support shaft 15 is formed at its upper and lower ends with pins 15*a* adapted for fitting in the holes 14. The pins 15*a* are each fitted in the associated hole 14 by way of the notched slot 14*a* and the first and second cover segments 12A and 12B are joined to open and close with the support shaft 15 serving as a fulcrum. Since the notched slot 14*a* decreases in width toward its end opening into the hole 14 and since the width of this open end is smaller than the diameter of the pin 15*a*, once the first and second cover segments 12A and 12B** are joined in the previously mentioned manner, they will not be disjoined easily.

A locking member 16 is formed on the outer wall of the first cover segment 12A which is opposite to the joint, and a pawl 17 adapted for engagement with the locking member 16 is formed on the second cover segment 12B correspondingly. When the pawl 17 is engaged with the locking member 16, the first and second cover segments 12A and 12B are also joined at this portion. In this way, the first and second cover segments 12A and 12B are joined and assembled at the ends of the parting line 11, thus completing the whole cover 10. By elastically deforming and disengaging the pawl 17 with the locking member 16, it is possible to release the joint at this portion.

The cover segments 12A and 12B are each formed with a semi-circular cutout along the joint so as to form a single circular opening 18 when they are assembled. The purpose of the opening 18 is to receive the high tension cord 2 and the rubber cap 3 and the opening 18 fits closely on the outer surface of the rubber cap 3. Formed on the lower open end edge of the cover segments 12A and 12B is a pawl 19 adapted to be locked to the stepped portion of the ignition coil 1. Inside of the cover segments 12A and 12B are formed a plurality of banks 22 for preventing overshooting of the cover segments 12A and 12B which are fitted over the ignition coil 1. Also an expansion 20 is provided on the outer surface of the first cover segment 12A and a cutout portion 21 is formed inside the expansion 20. The cutout portion 21 which is utilized to bring to the outside the primary terminal lead wires of the ignition coil 1, is covered by the expansion 20 and is also opened downwardly.

With the cover 10 constructed in the above-mentioned manner, when the first and second cover segments 12A and 12B are assembled and fitted on the ignition coil 1, there exists no such cutout which extends from the upper ends to the lower ends. Consequently, there is practically no possibility of salt water, water or the like entering the cover 10, thus preventing any leakage of the voltage. The cutout portion 21 for bringing the primary lead wires to the outside can be made extremely narrow and the entry of water through this portion is practically negligible.

The cover 10 is fitted on the ignition coil 1 by first disengaging the pawl 17 with the locking member 16 to open the cover segments 12A and 12B, fitting the cover segments 12A and 12B on the ignition coil 1, closing the cover segments 12A and 12B and then engaging the pawl 17 with the locking member 16 to assemble the cover segments 12A and 12B. In this way, as mentioned previously, it is possible to dispense with the cutout heretofore required for passing the high tension cord 2 and also there is no need to preliminarily run the high tension cord through the cover, thus greatly simplifying the mounting operation of the cover.

Figure 4:
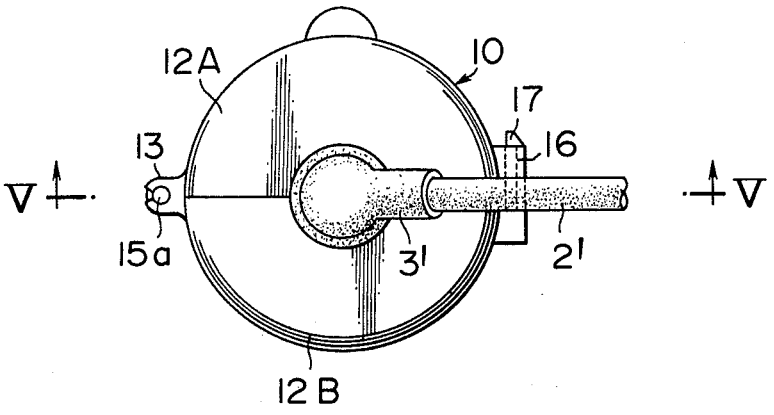
FIG. 4 is a plan view showing another embodiment of the invention.
Figure 5:
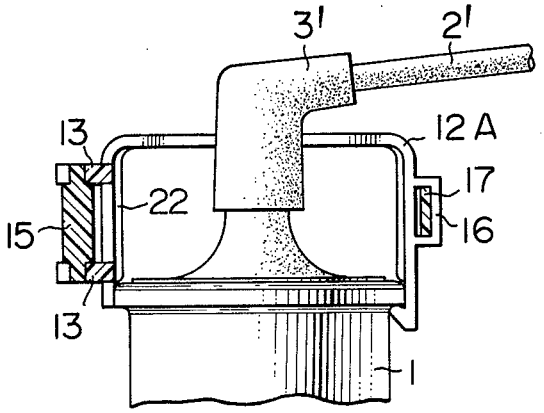
FIG. 5 is a sectional view taken along the line V—V of FIG. 4.

The invention can also be applied to the ignition coil 1 of the type to which are connected a high tension cord 2' and a rubber cap 3' each having its forward end formed into an L-shape as shown in FIGS. 4 and 5.

What we claim is:

1. A cover for an ignition coil having a peripheral enlargement at the top thereof, said cover comprising:

first and second diametric cover segments defining, when assembled, an inverted cup;

a pair of vertically spaced lateral projections on said first cover segment along one side edge thereof;

a support shaft integrally formed on said second cover segment at one side edge thereof for engagement with said pair of projections for pivotal opening and closing movements of said segments;

a locking member provided on one of said cover segments adjacent the other side edge thereof;

a first pawl member provided on the other of said cover segments adjacent the other side edge thereof for engagement with said locking member; and second pawl members provided on said first and second cover segments to engage over the enlargement of the ignition coil to lock said cover thereto.

2. A cover according to claim 1, wherein said cover segments are formed to have semi-circular cutouts which form a single circular opening at the bottom of the cup when said cover segments are assembled for the accommodation of at least one high tension cord of the ignition coil which passes through said opening, one of said cover segments being provided with an expanded portion on the outer surface thereof, said expanded portion having a cutout at the inside thereof for a primary terminal lead wire of the ignition coil which passes through said cutout.

* * * * *